United States Patent [19]

Kambara et al.

[11] Patent Number: 4,599,292

[45] **Date of Patent: * Jul. 8, 1986**

[54] METHOD AND DEVICE OF DEVELOPING AN ELECTROSTATIC LATENT IMAGE

[75] Inventors: Jun Kambara; Yuzo Ohmuro; Nin-ichi Kamogawa, all of Hino, Japan

[73] Assignee: Konishiroku Photo Industry Co., Ltd., Tokyo, Japan

[ * ] Notice: The portion of the term of this patent subsequent to Sep. 10, 2002 has been disclaimed.

[21] Appl. No.: 740,294

[22] Filed: May 31, 1985

Related U.S. Application Data

[60] Continuation-in-part of Ser. No. 628,767, Jul. 9, 1984, Pat. No. 4,540,646, which is a continuation of Ser. No. 496,982, May 24, 1983, abandoned, which is a continuation of Ser. No. 326,588, Dec. 2, 1981, abandoned, which is a division of Ser. No. 832,019, Sep. 9, 1977, abandoned, which is a division of Ser. No. 608,274, Aug. 27, 1975, abandoned.

[30] Foreign Application Priority Data

Aug. 28, 1984 [JP] Japan ..... 59-99385

[51] Int. Cl.[4] ..... G03G 13/08; G03G 13/09

[52] U.S. Cl. ..... 430/122

[58] Field of Search ..... 430/106.6, 107, 122, 430/903

[56] References Cited

U.S. PATENT DOCUMENTS

| | | | |
|---|---|---|---|
| 3,345,294 | 10/1967 | Cooper | 430/106.6 |
| 3,627,682 | 12/1971 | Hall et al. | 430/106.6 |
| 3,639,245 | 2/1972 | Nelson | 430/106.6 |
| 3,645,770 | 2/1972 | Flint | 430/106.6 |
| 3,909,258 | 9/1975 | Kotz | 430/106.6 |
| 3,947,370 | 3/1976 | Miller | 430/106.6 |
| 4,540,646 | 9/1985 | Kambara et al. | 430/106.6 X |

*Primary Examiner*—Roland E. Martin

*Attorney, Agent, or Firm*—Jordan B. Bierman

[57] ABSTRACT

Method for forming a toner image on a photosensitive material bearing an electrostatic latent image comprising (a) introducing a one component developer consisting of fine toner particles, said toner particles comprising ferromagnetic powder dispersed in a resin such that at least a portion of said ferromagnetic powder is not totally encased by said resin, said toner particles being capable of accepting a triboelectric charge and having a specific resistivity of $10^{14}$ ohm.cm, into a toner vessel which includes a regulating plate for controlling the amount of toner to be fed, (b) feeding said toner onto a toner feeder comprising a non-magnetic cylinder drum and a plurality of magnets disposed therein so that north and south poles are directed to the inner surface of said non-magnetic cylinder, (c) carrying said toner along said non-magnetic cylinder into close proximity to said electrostatic latent image, said toner particles developing a triboelectric charge of a polarity opposite to that of said electrostatic latent image during steps (a) through (c) in the absence of a corona discharging device, and (d) bringing said toner particles into contact with said electrostatic latent image.

42 Claims, 5 Drawing Figures

METHOD AND DEVICE OF DEVELOPING AN ELECTROSTATIC LATENT IMAGE

This is a continuation-in-part of application Ser. No. 628,767 filed July 9, 1984, now U.S. Pat. No. 4,540,646 which is a continuation of application Ser. No. 496,982, filed May 24, 1983, now abandoned, which is a continuation of application Ser. No. 326,588, filed Dec. 2, 1981, now abandoned, which is a divisional of application Ser. No. 832,019, filed Sept. 9, 1977, now abandoned, which is a divisional of application Ser. No. 608,274, filed Aug. 27, 1975, now abandoned, which claims priority of Japanese Application No. 99385/1974, filed Aug. 28, 1974.

This invention relates to a method of developing electrostatic latent images, and especially a development method using a one-component type developer consisting of a toner alone.

Among the methods for developing electrostatic latent images which have generally been used for machines utilizing electrophotography or electrostatic recording, there are: the magnetic brush, cascade, and wet development methods, and the like. Each of these developing methods is advantageous in that images of good quality can be obtained, but the two-component type developers, used in these methods, result in defects such as carrier fatigue and changes in the toner content in the developer.

A number of developing methods using one-component type developers containing a toner alone (free of carrier particles) have been disclosed. Such developing methods include a touchdown method, an impression method, a fur brush method, a powder cloud method, and an electrostatic induction method using a conductive toner. However, none of these methods has been practically used. The magnetic dry development method, which is combined in some office copying machines recently marketed by a few companies, is a development method included in the above-mentioned electrostatic induction method. In this development method, a conductive and ferromagnetic toner, which is detailed in West German Laid-Open Patent Specification No. 2,313,297, is employed. This method is advantageous in that electrostatic latent images of either negative polarity or positive polarity can be developed by the same toner. However, because the toner is of conductive nature, when once developed images are transferred onto a receiver such as white paper, the sharpness of the images is degraded and images of good quality can hardly be obtained. In order to overcome this disadvantage, the image transfer is practically conducted according to a method in which the transfer paper is contacted with a photosensitive layer by a conductive roller applied with an electric voltage, without adopting a customary corona discharge transfer method. However, this transfer method, using a conductive roller, involves relatively troublesome problems, i.e. difficulty in changing the size (width) of transfer paper and requiring a mechanism for pressing the roller against the photosensitive layer surface and separating the roller from the photosensitive layer surface.

Accordingly, practical and excellent development methods using an insulating toner are now eagerly desired in the art. It is therefore an object of this invention to satisfy this desire. Namely, it is a primary object of this invention to provide a development method using a novel one-component type developer free of carrier particles, which method can provide images of high quality. Particularly, the sharpness of the image is not degraded even by corona discharge transfer.

Briefly, the development method of this invention is characterized in that a toner prepared by incorporating a suitable amount of a ferromagnetic fine powder in toner particles so that a vast number of faces of such powder are exposed on the surface of these toner particles is used as the developer. The development method can be performed conveniently by giving positive and negative charges to the toner particles (by the triboelectric effect among the particles) and forming ears (composed of a plurality of the toner particles) by a magnet. Accordingly, a simplified magnetic development apparatus can be used for practice of this invention and supply of the toner can be performed by very simple means. Specifically, there is no need for the typical corona discharge, yet the problems set forth above by the elimination of the corona discharge are not encountered. Moreover, the toner to be used in this invention is required to have specific peculiar properties not possessed by conventional toners. Namely, the toner should have sufficiently high triboelectric chargeability and good ear-forming property, and since no carrier particles are employed, the toner should have good flowability.

This invention is very unique and epoch-making in that the functions performed by the two components, that is a toner and a carrier, in the conventional techniques, are performed exclusively by a toner alone. Further, the effects attained by this characteristic feature are superior to those attained in any of conventional development methods and the method of this invention is advantageous over any of the conventional methods especially as regards simplification of the apparatus and easy maintenance thereof.

The functions of a carrier such as iron powder used in the conventional magnetic brush development method, namely, imparting charges to toner particles and forming ears which contact with the surface carrying electrostatic images under the action of a magnet, are performed by the one-component toner in this invention. Accordingly, the composition and particle structure should be arranged to meet the above purpose sufficiently.

The first function of imparting charges to toner particles by friction among them will now be discussed. It is known that if particles of the same substance are frictionally contacted with one another, the attained charges, in general, cannot be large. For example, by simple experiments it was confirmed that the charge quantity obtained by agitating a pulverized resin is smaller than $10^{-9}$ coulomb/cm$^3$, whereas the charge quantity of toner particles forming a developed image by a magnetic brush method, a cascade method, or the like is in the order of $10^{-5}$ coulomb/cm$^3$.

The toner per se should have a magnetic property sufficient for the toner particles to perform the other function, namely the function of forming ears having a sliding contact with the surface of an electrostatic latent image under an action of a magnet. For attaining this feature, we incorporate and disperse a fine powder of a magnetic substance into a resin. In this case, since the magnetic substance is used as a toner component, it is preferred that the magnetic substance be black. If its color is not black, it is necessary to incorporate a black pigment such as carbon black into the toner. In view of the foregoing, magnetite (triiron tetroxide) is preferred as the magnetic substance. In preliminary experiments, several kinds of toners were prepared according to the spray drying method by using mixtures of an epoxy resin and magnetite differing in the mixing ratio. As a result, it was found that when the magnetic content is higher than about 60%, the toner generally has better flowability and better ear-forming properties.

Development experiments were carried out by using these toners and a experimental apparatus shown in FIG. 1. In FIG. 1, reference numeral 1 denotes a permanent magnet structure comprising N and S poles arranged alternately and non-magnetic blocks disposed between every two adjacent poles and bonded thereto by an adhesive. A toner 3 is applied on the surface of a plate 2 of a non-magnetic metal such as brass or aluminum. A photosensitive plate 4 is composed of a conductive substrate 6 and a photoconductive layer 5. Electrostatic latent images are formed on the photoconductive layer 5 according to a customary process. A spacer (not shown) is disposed between the metal plate 2 and the photosensitive layer 5 to maintain a clearance of about 1 mm therebetween. During the developing step, the metal plate 2 is slid to the right and left so that ears of the toner have a sliding contact with the surface of a latent image. The photosensitive plate 4 is gradually moved, for example, from the left to the right, so that the entire surface is developed. In this experimental apparatus, several toners were tested by combining them with several photosensitive materials to obtain results shown in Table 1. In this Table, evaluations given on the left column of each photosensitive material are those of the developed images and evaluations given on the right column are those of images transferred on white paper using corona discharge method. In the case of a selenium photosensitive material and an equimolar mixture of polyvinyl carbazole and trinitrofluorenone (PVK/TNF), which provide both positive and negative latent images, the evaluation was conducted with respect to both images. In the Table, evaluation is indicated by symbols◎, ○, Δ, and X as implying best quality, satisfactory quality, permissible quality and unsatisfactory quality of the obtained images, respectively.

TABLE 1

| Magnetite | Photosensitive Material | | | | | |
|---|---|---|---|---|---|---|
| Content (%) | ZnO (−) | Se (+) | Se (−) | PVK/Se (−) | PVK/TNF (−) | PVK/TNF (+) |
| 70 (%) | ◎○~Δ | ○Δ~X | ○Δ~X | ○Δ~X | ○Δ~X | ○Δ~X |
| 60 | ◎◎ | Δ Δ | Δ Δ | Δ~X Δ~X | Δ Δ | Δ Δ |
| 50 | ○~Δ Δ | X X | X X | X X | X X | X X |
| 40 | X XX | XX XX | XX XX | XX XX | XX XX | XX XX |
| 30 | XX XXX | XXX XXX | XXX XXX | XXX XXX | XXX XXX | XXX XXX |

As is seen from the Table, good results were obtained in the case of a combination of a toner of a magnetite content of 60% and the ZnO photosensitive material, and practically satisfactory results were obtained for a magnetite content ranging from 50% to 65%. In the case of a combination of a toner of a magnetite content of 70% and the ZnO photosensitive material, reduction of the image sharpness by transfer was conspicuous. The reason is considered to be that magnetite particles in the toner particles agglomerate to reduce the specific resistivity of the toner.

Results of an example of measurement of changes in the specific resistivity by the magnetite content are shown in FIG. 2. In general, the specific resistivity of the toner varies depending on the dispersion state, the particle size, the pressure at the time of measurement and the applied voltage, even if the same magnetite and resin are employed and the mixing ratio is kept constant. Accordingly, it must be noted that results shown in FIG. 2 are those under specified conditions. Under these conditions, the pressure was 1 kg/cm$^2$, the applied voltage was 100 V and the thickness of the sample layer was about 4 mm. In this manner, the specific resistivity and the reduction of the image sharpness by transfer were examined. It was found that the specific resistivity should be at least $10^{14}$ Ωcm.

What must be noted among the facts seen from the results shown in Table 1 is that in the case of the Se photosensitive material and the PVK/TNF photosensitive material, the developing effect is substantially the same for both of the cases where latent images are of negative charge and of positive charge. This apparently indicates that positively charged particles and negatively charged particles are present in substantially the same amounts in toner. Images formed on photosensitive materials other than ZnO had a very high edge effect and the image density was not so high in these images. In the case of images formed on the ZnO photosensitive material, black areas could be reproduced in a very good state and no substantial edge effect was observed. However, in the case of a toner of a lower magnetite content, adhesion of the toner was observed around the image, and hair-like protrusion of the toner from contours of the image or roughening of the granularity of the image was conspicuous and the ear-forming ability of the toner was poor. Accordingly, the image was non-uniform and contamination of the image was conspicuous.

When the charge quantity was measured with respect to a toner forming good images on the ZnO photosensitive material, it was found that the charge quantity was about $5\times10^{-6}$ coulomb/cm$^3$. This value is slightly lower than the value obtained in the case of conventional magnetic brush development, but it is much higher than the value obtained in the above-mentioned case where particles of one substance are frictionally contacted with one another. When photos of the toner particles were taken under an electron microscope of about 1000 magnifications, it was found that fine projections were uniformly distributed on surfaces of the particles and respective projections had a size of about 0.2 to about 0.3$\mu$.

We drew the following inference from the foregoing observations and the experimental results shown in Table 1.

A vast number of magnetite fine particles are exposed from the surface of respective toner particles, and when the magnetite content is about 60%, this exposed state is uniform throughout the entire surfaces. While the prepared toners are stored in a bottle or attracted to adhere on the top portion of the magnet at the developing step, they are frictionally in contact with one another and the magnetite present on the particle surfaces are rubbed with the resin, whereby the magnetite will be negatively charged and the resin will be positively charged. The toner as a whole has none of such frictionally developed charges, but respective particles have a vast number of positive and negative charges on the surface thereof and the charges on the entire surfaces of respective particles can be positive or negative. It is believed that particles charged relatively positively are preferably used for developing negatively charged latent images.

In general, at the developing step, every time one toner particle is caused to adhere on the latent image, the carrier particles should be deprived of charges of a reverse polarity in correspondence to the charges of said particle. In this invention, however, none of the carrier particles are used, and therefore, when, for example, positively charged particles are caused to adhere to the latent image surface, it is necessary that electrons should be injected into the photosensitive layer from the magnetite faces of the negatively charged particles (since the toner has insulating properties, charges are not allowed to move along ears of the toner). In case positively charged images are developed, every time one negatively charged particle is caused to adhere to the latent image surface, it is necessary that an electron is injected into the magnetite of the corresponding adjacent positive particle from the photosensitive layer to thereby deprive the positive particle of the charge. In a zinc oxide photosensitive material, the above mechanism is allowed to proceed very smoothly, and the charge distribution on the surface of the photosensitive layer is microscopically non-uniform. Accordingly, the intensity of the surface electric field is enhanced. For these reasons, it is construed that especially good results are obtained when a zinc oxide photosensitive material is used.

The foregoing can be summarized as follows:

1. Respective toner particles comprise fine particles of a magnetic substance dispersed in a resin, and faces of the magnetic substance particles are exposed.

2. The magnetic substance is negatively charged by frictional contact with the resin (the resin is positively charged).

3. A ZnO-resin dispersion layer is used as a photosensitive layer.

4. N and S poles arranged alternately, a non-magnetic plate, a toner adhering thereon and a photosensitive plate having contact with tips of ears of the toner are disposed in this order, and a relative movement is conducted between the magnetic poles and the metal plate.

These matters will now be expatiated.

The magnetic substance to be used in this invention should satisfy the foregoing requirements 1 and 2, and it is also required that it should be deprived of negative charges by injection of electrons into the ZnO photosensitive layer. Therefore, the magnetic substance should be a conductor or semiconductor of the electronic conduction type. Since it is required that the toner should be black, if the magnetic substance is not black, carbon black or other black dye or pigment should be added, resulting frequently in bad influences on the electric resistance and the triboelectric chargeability. Accordingly, it is considered preferable for the magnetic substance to be black, have a good dispersibility in the resin, be chemically stable and be easily formed in fine particles having a size not exceeding 1$\mu$. Magnetite satisfies substantially all of these conditions, and it is used most preferably as the magnetic substance in this invention. Of course, fine particles of various ferrites, iron, cobalt and nickel can be used when combined with appropriate resins.

The resins to be used in this invention are chosen with regard to the chargeability on friction with the magnetic substance used, the manufacturing process and conditions, the covering property to the magnetic substance, the adaptability to thermal fixation and other factors. Styrene resins, acrylic resins, vinyl resins, epoxy resins, cellulose resins, polyurethane resins and copolymers thereof are appropriately chosen and used. They are used singly or in the form of a mixture of two or more of them.

The toner of this invention is prepared from an appropriate combination of the magnetic substance and resin as mentioned above according to a known toner-preparing process. A most popular process for preparing toners comprises heating and kneading a resin and a pigment by two rollers and pulverizing the resulting mixture. There is also known a spray-drying process such as disclosed in the specification of U.S. Pat. No. 3,338,991.

As pointed out repeatedly hereinbefore, it is an indispensable requirement that fine particles of the magnetic substance are exposed on the surfaces of the toner particles, and it is important that the toner is prepared so that this requirement is satisfied in the resulting toner. This condition is greatly influenced by the kinds of the magnetic substance and resin to be used and the content of the magnetic substance. In the spray-drying process, as the dispersion state is better, the particles of the magnetic substance are better covered with the resin, and as the amount of the solvent is smaller, the disc rotation number is larger and feeding air temperature is lower, a better coating is obtained. If the degree of exposure of the particles of the magnetic substance is too high, the specific resistivity of the toner is lowered and the triboelectric charge quantity of each particle cannot become large. Accordingly, it is necessary to take care so that the degree of exposure is not too high.

All of commercially available zinc oxide photosensitive materials used for copying machines of the electrofax type can be used as the zinc oxide photosensitive material in this invention. Since this invention is directed to the transfer of developed images on ordinary papers, use of zinc oxide photosensitive materials to be used for PPC (plane paper copiers) is preferred, and a commercially available master paper for a U-bix copying machine (manufactured by Konishiroku Photo Industry Co., Ltd.) is a most preferred example of such photosensitive material.

Figure 1:
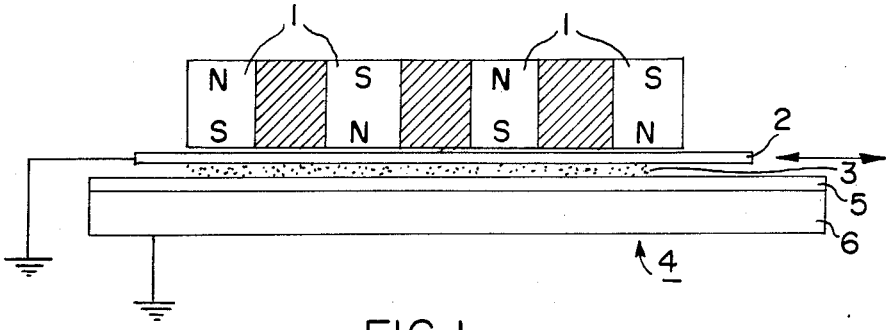
FIG. 1 is a view illustrating the principle of the apparatus to be used for carrying out the developing method of this invention.
Figure 2:
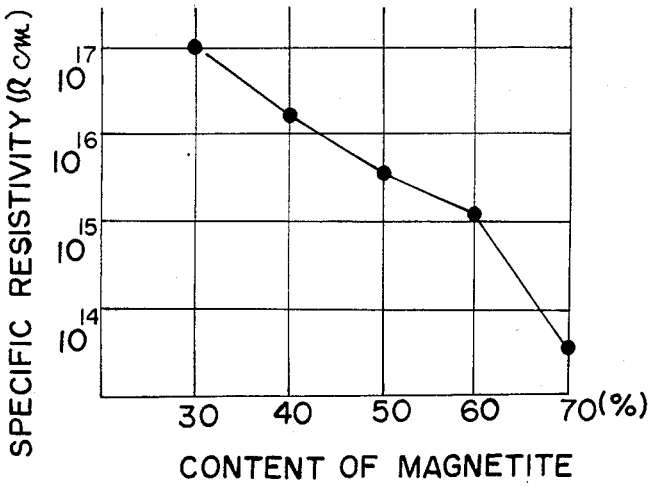
FIG. 2 is a diagram showing the relation between the electric resistivity of the toner and the content of a magnetic substance in the toner.

A developing device having a principle as shown in FIG. 1 is preferably employed in this invention. The intended object of this invention can be attained even if magnetic poles are not strictly disposed in N-S alternating arrangement. Further, the development can be performed even if magnetic poles 1 and metal plate 2 are fixed to each other and they are integrally moved, though the image quality is reduced to some extent. Since the apparatus shown in FIG. 1 is an experimental apparatus, in an actual operation a modification should be made so that feeding of the toner onto the metal plate and movement of the metal plate can be performed continuously. An example of such modification is illustrated in FIG. 3.

Figure 3:
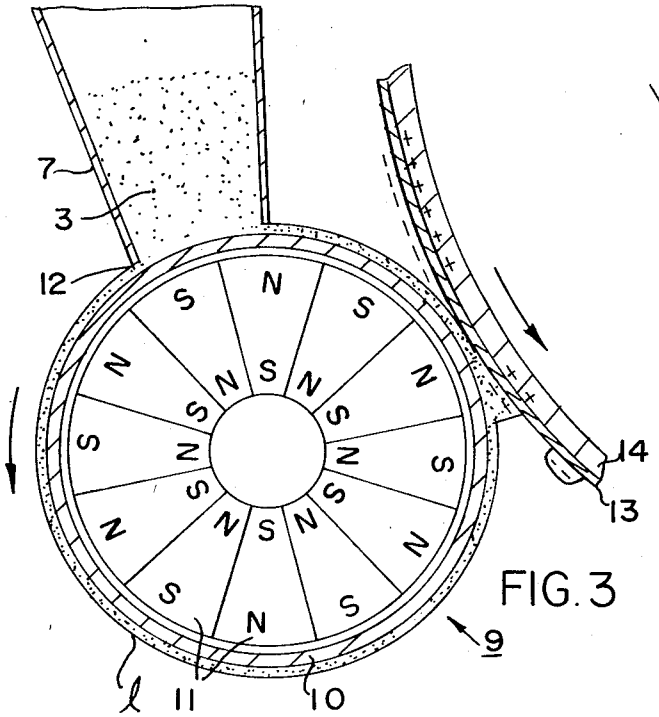
FIG. 3 shows one embodiment of the development apparatus to be used for working the developing method of this invention.

In FIG. 3, reference numerals 7 and 3 denote a toner vessel and a toner, respectively, and the toner 3 is fed onto a surface carrying electrostatic images from the toner vessel 7 by a toner feeder 9 and is subjected to the development treatment. The feeder 9 comprises a non-magnetic cylinder 10 and a permanent magnet 11 disposed in the interior of the cylinder and including N and S poles arranged alternately. A zinc oxide photosensitive layer 13 is coated on a drum type substrate 14. l indicates a toner layer, and when the metal cylinder 10 is rotated in a direction indicated by an arrow, the toner 3 is attracted from the toner vessel 7 through a clearance formed between a regulating plate 12 and the peripheral face of the cylinder 10 by the attracting force of the magnetic poles 11. In FIG. 3, the toner layer l is drawn as though it has a uniform thickness, but actually, ears rise at parts confronting the centers of the respective poles while other portions of the toner layer l remain flat. Even if positions of the magnetic poles are slightly deviated in the vertical direction by rotating and moving them entirely, development can be performed.

Figure 4:
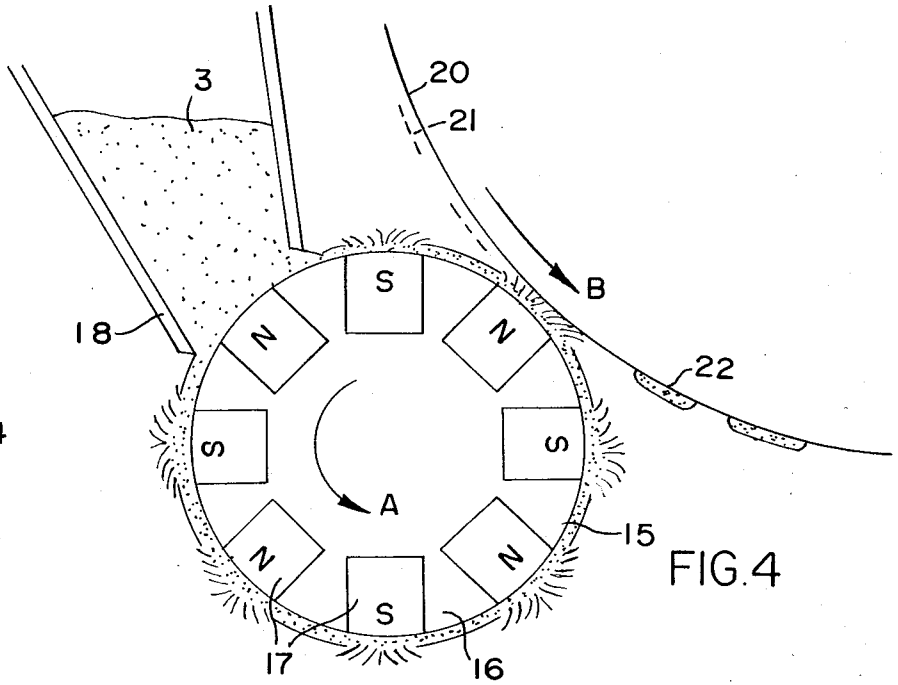
FIGS. 4 and 5 show another embodiment of the developing apparatus to be used for working the developing method of this invention.

FIG. 4 illustrates another preferred embodiment of the apparatus used in this invention. A developing roller 15 comprises a core 16 composed of a non-magnetic material such as aluminum or brass and a number of magnets 17 disposed on its outer peripheral face. A toner 3 is charged in a toner vessel 18, and when the developing roller 15 is rotated in a direction indicated by an arrow A, the toner is held on the magnets 17 by the attractive force thereof and is withdrawn from the toner vessel 18 as the developing roller 15 is rotated. When N and S poles are arranged alternately as is shown in FIG. 4, the toner is held between every two adjacent poles by the action of the lines of magnetic force, and the toner ears, in a brush-like form, appear on the magnet 17 where the lines of magnetic force are vertically upwardly directed. If a mutual relation between the developing roller 15 and the photosensitive material 20 is established so that the eared toner is allowed to have a sufficient contact with the photosensitive material 20, an electrostatic latent image 21 on the photosensitive material 20 advancing in a direction indicated by an arrow B is developed to form a toner image 22. Development on portions other than ears causes fogs, and accordingly, it is preferred that the development be performed only on earing portions. Uneven development caused by the presence of clearances between two adjacent ears can be prevented sufficiently if the developing roller 15 is rotated at a peripheral speed several times the peripheral speed of the photosensitive material 20. The advantage attained in this embodiment is that since the toner is held directly by the magnet 17, a high magnetic force can be utilized and development can be performed stably, and that the structure is simpler than that of an apparatus of the sleeve type.

In FIG. 4, magnets of N and S polarities are arranged alternately, but in this embodiment, since development is performed by eared portions alone and these eared portions are held directly on the magnets, they need not be arranged in such N-S alternating relationship.

Figure 5:
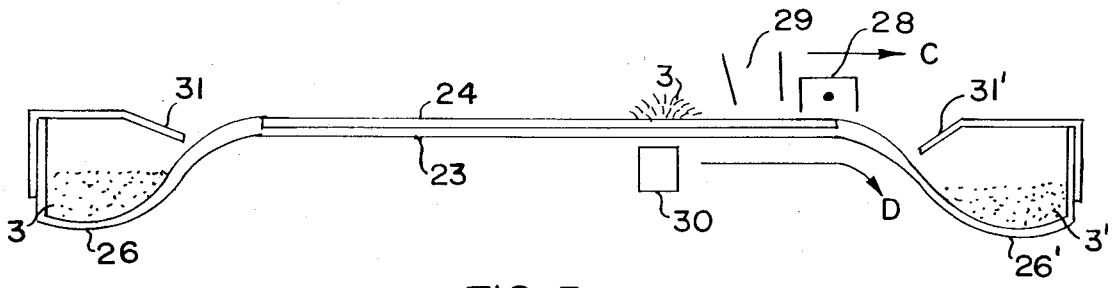

Still another embodiment of the apparatus used in this invention is illustrated in FIG. 5.

A photosensitive plate 24 is disposed at a central flat portion of a supporting basin 23 composed of a non-magnetic substance, and left and right side portions of the supporting basin 23 form toner vessels 26 in which a toner 3 is filled. A charger 28 and an exposure slit 29 are moved over the photosensitive material 24 in a direction indicated by an arrow C to form an electrostatic latent image, and then a magnet 30 is moved under the back surface of the photosensitive material 24 in a direction indicated by an arrow D and development takes place with the toner 3 held by magnet 30 through the photosensitive material 24 and the supporting basin 23.

According to the method of this invention using a toner 3 and a photosensitive material 24 in combination, even if electrodes confronting to the zinc oxide photosensitive material 24 are not disposed, solid and clear images free of an edge effect can be obtained by the above development procedures.

The magnet 30 is so arranged that it is moved while profiling the supporting basin 23. Accordingly, the toner 3 withdrawn from the left vessel 26 is charged in the right vessel 26' and it is then returned to the left vessel 26. The top ends 31 and 31' of the vessels 26 and 26' form ear height-regulating plates for controlling the height of ears attracted to the magnet 30.

Apparatuses shown in FIGS. 3, 4 and 5 are embodiments of the apparatus to be used for practicing the method of this invention, and as is apparent to those skilled in the art, various modifications may be made based on the principle illustrated in FIG. 1.

This invention will now be illustrated in detail by reference to the following Examples.

EXAMPLE 1

| | |
|---|---|
| Epon 1004 (epoxy resin manufactured by Shell Chemical) | 240 g |
| Mapico Black (triiron tetroxide manufactured by Columbia Carbon) | 360 g |
| Toluene | 280 g |
| Acetone | 120 g |
| Total | 1,000 g |

The above composition was dispersed for 32 hours in a porcelain ball mill and then granulated according to the spray drying method using a rotary disc. The spray drying conditions were as follows:

| | |
|---|---|
| Solvent: | |
| toluene | 1680 g |
| acetone | 720 g |
| Non-volatile solids: | 600 g |
| Rotation number of rotary disc: | 44,000 r.p.m. |

Thus, there were obtained black spherical toner particles having an average particle size of about 10μ.

A copying machine U-bix 800 (manufactured by Konishiroku Photo Industry Co., Ltd.) of which a developing device was taken out, was used. First, a copy button was depressed and when formation of an electrostatic image on a master paper was completed, a power switch was put off to stop the machine. A master paper was taken out under safety light, and development was carried out with the above toner by using an apparatus based on the principle shown in FIG. 1. Then, the master paper was set in the machine again, and after charging and exposure devices had been inactuated, the copy button was depressed and the developed image was transferred to an ordinary paper. A good image was obtained.

EXAMPLE 2

| | |
|---|---|
| Pliolite ACL (styrene-acrylic acid copolymer manufactured by Goodyear Chemical) | 240 g |

-continued

| | |
|---|---|
| Mapico Black (triiron tetroxide manufactured by Columbia Carbon) | 360 g |
| Toluene | 280 g |
| Acetone | 120 g |
| Total | 1000 g |

The above composition was dispersed in a porcelain ball mill for 16 hours and granulated according to the spray drying method using a rotary disc. The spray drying conditions were as follows:

| | |
|---|---|
| Solvent: | |
| toluene | 1260 g |
| acetone | 540 g |
| Non-volatile solids: | 600 g |
| Rotation number of rotary disc: | 49,000 r.p.m. |
| Drying air temperature: | 190° C. |

Thus, there were obtained black spherical toner particles having an average particle size of about 10μ, and when an image was formed by using the so prepared toner in the same manner as described in Example 1, good results were obtained.

EXAMPLE 3

| | |
|---|---|
| Pentalyn A (rosin ester of pentaerythritol manufactured by Hercules Co.) | 240 g |
| Mapico Black | 360 g |
| Toluene | 280 g |
| Acetone | 120 g |
| Total | 1,000 g |

The above composition was dispersed for 4 hours in a porcelain ball mill and granulated according to the spray drying method using a rotary disc. The spray drying conditions were as follows:

| | |
|---|---|
| Solvent: | |
| toluene | 1680 g |
| acetone | 720 g |
| Non-volatile solids: | 600 g |
| Rotation number of rotary disc: | 44,000 ppm |
| Drying air temperature: | 170° C. |

Thus, there were obtained black spherical toner particles having an average particle size of about 10μ, and in the same manner as described in Example 1, development was conducted by using the so prepared toner and the developed image was transferred. An image of good quality was obtained.

EXAMPLE 4

| | |
|---|---|
| Piccolastic C125 (styrene resin manufactured by Pennyslvania Industrial Chemical) | 168 g |
| Piccovar 450H (polyindene resin manufactured by Pennsylvania Industrial Chemical | 72 g |
| Mapico Black | 360 g |
| Toluene | 280 g |
| Acetone | 120 g |
| Total | 1000 g |

The above composition was dispersed for 17.5 hours in a porcelain ball mill, and then granulated according to the spray drying method using a rotary disc. The spray drying conditions were as follows:

| | |
|---|---|
| Solvent: | |
| toluene | 1260 g |
| acetone | 540 g |
| Non-volatile solids: | 600 g |
| Rotation number of rotary disc: | 49,000 r.p.m. |
| Drying air temperature: | 190° C. |

Thus, there were obtained black spherical toner particles having an average particle size of about 10μ. In the same manner as described in Example 1, development was carried out by using the so prepared toner and the developed image was transferred. An image of good quality was obtained.

As a result of experiments made separately, it was confirmed that each of the resins used in the foregoing Examples was positively charged by frictional contact with magnetite (Mapico Black). Further, from electron microscope photographs of toners obtained in the foregoing Examples it was confirmed that fine convexities having a size corresponding to the size of magnetite particles were uniformly distributed on the surfaces of the toner particles.

EXAMPLE 5

| | |
|---|---|
| Piliolite ACL | 400 g |
| Mapico Black | 600 g |
| Total | 1000 g |

The above composition was kneaded at 65° C. for 10 minutes by means of a two-roll mill and ground by a jet grinder. Then, the ground product was granulated for 16 hours together with 500 g in a porcelain ball mill and dried for 1 week in an air current maintained at 40° C. Then, the resulting powder was sprayed and injected in a drier by a bi-fluid type nozzle and made spherical by feeding hot air (190° C.) in the drier. Thus, there were obtained black spherical toner particles having an average particle size of about 10μ. In the same manner as described in Example 1, development was carried out by using the so prepared toner and the developed image was transferred. An image of good quality was obtained.

Each of the toners used in the foregoing five Examples was composed of spherical particles. However, in this invention, it is not a critical requirement that toner particles should have a spherical form. As a result of our experiments, it was confirmed that spherical toners have generally better flowability than pulverized non-spherical toners. Of course, some of pulverized non-spherical toners were found to have a sufficient flowability and they could be effectively used in this invention directly in the pulverized state. No definite critical value is found as regards the flowability, but particles having a Carr flowability index lower than 30 are not suitable and use of particles having a Carr flowability index higher than 50 is preferred.

In the foregoing illustration, the triboelectric chargeability of the resin used in the toner of this invention have been discussed with respect to the magnetic substance alone. Through our experiments, we empirically found the following facts as regards the triboelectric chargeability of the toner of this invention with respect to the photosensitive layer.

As shown in Table 2 given hereinafter, when 8 toners, A to H, were tested on the triboelectric chargeability to the photosensitive layers, it was found that 4 toners, A to D, were positively charged and another 4 toners, E to H, were negatively charged. When images were formed by using these toners in the same manner as in the preceding Examples, it was found that transferred images formed by using toners A to D were a little superior to transferred images formed by using toners E to H in the image quality, namely the image density and sharpness.

Most of the resins have a negative triboelectric chargeability to ZnO photosensitive layers, and magnetite has also a negative triboelectric chargeability to ZnO photosensitive layers. However, when magnetite alone is compression-molded and the resulting mass is rubbed with a ZnO photosensitive material, it is seen that the magnetite is negatively charged but the charge quantity is very small and is substantially zero. Accordingly, it is believed that the triboelectric chargeability of the toner of this invention to the photosensitive layer depends mainly on properties of the resin. Toners A and D are those prepared by incorporating in a resin a charge controlling agent such as Nigrosine or a polymer or oligomer having a highly electron-donative functional group such as an amino group. Details of preparation of toners of this type will be apparent from Example 6 given hereinafter.

TABLE 2

| Kind of Toner | Triboelectric Chargeability to Photosensitive Layer | Image Quality |
|---|---|---|
| A | + | ◎ |
| B | + | ◎ |
| C | + | ◎ |
| D | + | ◎ |
| E | − | ○ |
| F | − | ○ |
| G | − | ○ |
| H | − | ○ |

EXAMPLE 6

| | |
|---|---|
| Epon 1004 | 222 g |
| Mapico Black | 360 g |
| Nigrosine SSB | 18 g |
| Toluene | 280 g |
| Acetone | 120 g |
| Total | 1000 g |

The above composition was dispersed for 16 hours in a porcelain ball mill and granulated by the spray drying method using a rotary disc. The spray drying conditions were as follows:

| | |
|---|---|
| Solvent: | |
| toluene: | 1680 g |

-continued

| | |
|---|---|
| acetone: | 720 g |
| Non-volatile solids: | 600 g |
| Rotation number of rotary disc: | 44,000 r.p.m. |
| Drying air temperature: | 170° C. |

Thus, there were obtained black spherical toner particles having an average particle size of 10μ. In the same manner as described in Example 1, development was carried out by using the so prepared toner and the developed image was transferred. The quality of the resulting image was slightly improved over the quality of the image obtained in Example 1.

From the foregoing illustration, those skilled in the art will readily understand the concept, structural requirements and working of this invention and from the foregoing Examples they will readily anticipate other similar embodiments of the method of this invention.

What we claim is:

1. A method for forming a toner image on a photosensitive material bearing an electrostatic latent image comprising (a) introducing a one component developer consisting of fine toner particles, said particles containing a resin and ferromagnetic powder dispersed in said resin in such a fashion that a portion of said ferromagnetic powder is exposed on the surface of said toner particles, said toner particles having a specific resistivity of at least $10^{14}$ ohm cm and being capable of accepting a triboelectric charge, into a toner vessel which includes a regulating plate for controlling the amount of toner to be fed, (b) feeding said toner onto a toner feeder comprising a non-magnetic cylinder drum and a plurality of magnets disposed therein so that south and north poles are directed to the inner surface of said non-magnetic cylinder, (c) carrying said toner, by rotary movement of either said non-magnetic cyclinder or said plurality of magnets, along the surface of said non-magnetic cylinder into close proximity to said electrostatic latent image, said toner particles developing a triboelectric charge, necessary to develop said electrostatic latent image, during steps (a) through (c) in the absence of a corona discharging device, and (d) developing said electrostatic latent image with said toner.

2. The method of claim 1 wherein said toner particles have been produced by a spray-drying process.

3. The method of claim 1 wherein said triboelectric charge is developed by virtue of mutual friction between toner particles.

4. The method of claim 1 wherein said ferromagnetic material is comprised of fine particles of ferrite.

5. The method of claim 1 wherein said ferromagnetic material is magnetite.

6. The method of claim 1 wherein said magnetite content is greater than 50%.

7. The method of claim 1 wherein said resin is selected from the group consisting of styrene resins, acrylic resins, vinyl resins, epoxy resins, cellulose resins, polyurethane resins, copolymers thereof, and mixtures thereof.

8. The method of claim 1 wherein said ferromagnetic material comprises particles of a size not exceeding one micron.

9. The method according to claim 1 wherein said toner particles are formed with fine projections having a size of 0.2 to 0.3 microns.

10. The method of claim 1 wherein said toner particles having Carr flowability index greater than 30.

11. The method of claim 1 wherein said toner particles having Carr flowability index greater than 50.

12. The method of claim 1 wherein said electrostatic latent image is a positive image.

13. The method of claim 1 wherein said electrostatic latent image is a negative image.

14. The method of claim 1 wherein said material bearing said electrostatic latent image is a photoconductive photosensitive material.

15. A method for forming a toner image on a photosensitive material bearing an electrostatic latent image comprising (a) introducing a one component developer consisting of fine toner particles, said particles containing a resin and ferromagnetic powder dispersed in said resin in such a fashion that a portion of said ferromagnetic powder is exposed on the surface of said toner particles, said toner particles having a specific resistivity of at least $10^{14}$ ohm cm and being capable of accepting a triboelectric charge, said specific resistivity being determined under the conditions that pressure is about 1 kg/cm$^2$, applied voltage is about 100 V, and the sample subjected to measurement is about 4 mm in thickness, into a toner vessel which includes a regulating plate for controlling the amount of toner to be fed, (b) feeding said toner onto a toner feeder comprising a non-magnetic cylinder drum and a plurality of magnets disposed therein so that south and north poles are directed to that south and north poles are directed to the inner surface of said non-magnetic cylinder, (c) carrying said toner, by rotary movement of either said non-magnetic cylinder or said plurality of magnets, along the surface of said non-magnetic cylinder into close proximity to said electrostatic latent image, said toner particles developing a triboelectric charge necessary to develop said electrostatic latent image during steps (a) through (c) in the absence of a corona discharging device, and (d) developing said electrostatic latent image with said toner.

16. The method of claim 15 wherein said toner particles have been produced by a spray-drying process.

17. The method of claim 15 wherein said triboelectric charge is developed by virtue of mutual friction between toner particles.

18. The method of claim 15 wherein said ferromagnetic material is comprised of fine particles of ferrite.

19. The method of claim 15 wherein said ferromagnetic material is magnetite.

20. The method of claim 15 wherein said magnetite content is greater than 50%.

21. The method of claim 15 wherein said resin is selected from the group consisting of styrene resins, acrylic resins, vinyl resins, epoxy resins, cellulose resins, polyurethane resins, copolymers thereof, and mixtures thereof.

22. The method of claim 15 wherein said ferromagnetic material comprises particles of a size not exceeding one micron.

23. The method according to claim 15 wherein said toner particles are formed with fine projections having a size of 0.2 to 0.3 microns.

24. The method of claim 15 wherein said toner particles having Carr flowability index greater than 30.

25. The method of claim 15 wherein said toner particles having Carr flowability index greater than 50.

26. The method of claim 15 wherein said electrostatic latent image is a positive image.

27. The method of claim 15 wherein said electrostatic latent image is a negative image.

28. The method of claim 15 wherein said material bearing electrostatic latent image is a photoconductive photosensitive material.

29. A method for forming a toner image on a photosensitive material bearing an electrostatic latent image comprising (a) introducing a one component developer consisting of fine particles, said particles containing a resin and ferromagnetic powder dispersed in said resin in such a fashion that a portion of said ferromagnetic powder is exposed on the surface of said toner particles, said toner particles having a specific resistivity of at least $10^{14}$ ohm cm and being capable of accepting a triboelectric charge, said specific resistivity being determined under the conditions that pressure is about 1 kg/cm$^2$, applied voltage is about 100 V, and the sample subjected to measurement is about 4 mm in thickness, into a toner vessel which includes a regulating plate for controlling the amount of toner to be fed, (b) feeding said toner onto a toner feeder comprising a non-magnetic cylinder drum and a plurality of magnets disposed therein so that south and north poles are directed to that south and north poles are directed to the inner surface of said non-magnetic cylinder, (c) carrying said toner, by rotary movement of either said non-magnetic cylinder or said plurality of magnets, along the surface of said non-magnetic cylinder into close proximity to said electrostatic latent image, said toner particles developing a triboelectric charge of a polarity opposite to that of said electrostatic lagent image during steps (a) through (c) in the absence of a corona discharging device, and (d) bringing said toner particles into contact with said electrostatic latent image.

30. The method of claim 29 wherein said toner particles have been produced by a spray-drying process.

31. The method of claim 29 wherein said triboelectric charge is developed by virtue of mutual friction between toner particles.

32. The method of claim 29 wherein said ferromagnetic material is comprised of fine particles of ferrite.

33. The method of claim 29 wherein said ferromagnetic material is magnetite.

34. The method of claim 29 wherein said magnetite content is greater than 50%.

35. The method of claim 29 wherein said resin is selected from the group consisting of styrene resins, acrylic resins, vinyl resins, epoxy resins, cellulose resins, polyurethane resins, copolymers thereof, and mixtures thereof.

36. The method of claim 29 wherein said ferromagnetic material comprises particles of a size not exceeding one micron.

37. The method according to claim 29 wherein said toner particles are formed with fine projections having a size of 0.2 to 0.3 microns.

38. The method of claim 29 wherein said toner particles having Carr flowability index greater than 30.

39. The method of claim 29 wherein said toner particles having Carr flowability index greater than 50.

40. The method of claim 29 wherein said electrostatic latent image is a positive image.

41. The method of claim 29 wherein said electrostatic latent image is a negative image.

42. The method of claim 29 wherein said material bearing electrostatic latent image is a photoconductive photosensitive material.

* * * * *

UNITED STATES PATENT AND TRADEMARK OFFICE

CERTIFICATE OF CORRECTION

PATENT NO. : 4,599,292

DATED : July 8, 1986

INVENTOR(S) : Jun Kambara, et al

It is certified that error appears in the above-identified patent and that said Letters Patent are hereby corrected as shown below:

The priority data should read "Japanese Serial No. 49-99385 filed August 28, 1974".

Signed and Sealed this

Seventeenth Day of February, 1987

*Attest:*

DONALD J. QUIGG

*Attesting Officer*

*Commissioner of Patents and Trademarks*